US008042197B2

(12) United States Patent
Maier

(10) Patent No.: US 8,042,197 B2
(45) Date of Patent: Oct. 25, 2011

(54) CYCLIST TROUSERS WITH PROTECTION PAD

(75) Inventor: Roger Maier, Carona (CH)

(73) Assignee: Assos of Switzerland S.A., San Pietro (CH)

( * ) Notice: Subject to any disclaimer, the term of this patent is extended or adjusted under 35 U.S.C. 154(b) by 359 days.

(21) Appl. No.: 12/260,791

(22) Filed: Oct. 29, 2008

(65) Prior Publication Data

US 2009/0113598 A1 May 7, 2009

(30) Foreign Application Priority Data

Oct. 30, 2007 (EP) ..... 07021135

(51) Int. Cl.
*A41D 1/08* (2006.01)

(52) U.S. Cl. ..... 2/228; 2/466

(58) Field of Classification Search ..... 2/466, 228, 2/238, 227, 401, 267, 79, 214, 215, 455, 2/467, 23, 69; 450/153, 97–100, 104
See application file for complete search history.

(56) References Cited

U.S. PATENT DOCUMENTS

| | | | | |
|---|---|---|---|---|
| 4,805,243 | A * | 2/1989 | Gibbens et al. | 2/228 |
| 5,103,505 | A * | 4/1992 | Llorens | 2/400 |
| 6,393,618 | B2 * | 5/2002 | Garneau | 2/228 |
| 6,565,702 | B1 * | 5/2003 | Forsyth et al. | 156/308.4 |
| 6,928,665 | B1 * | 8/2005 | Yates | 2/466 |
| 7,707,659 | B2 * | 5/2010 | Africa et al. | 2/267 |
| 7,757,311 | B2 * | 7/2010 | Garneau | 2/466 |
| 2002/0029409 | A1 * | 3/2002 | Coccia | 2/456 |
| 2003/0131399 | A1 | 7/2003 | Forsyth | |
| 2005/0066423 | A1 * | 3/2005 | Hogan | 2/227 |
| 2005/0210570 | A1 | 9/2005 | Garneau | |
| 2005/0223478 | A1 * | 10/2005 | Hogan | 2/466 |
| 2006/0191052 | A1 * | 8/2006 | Bulian | 2/23 |
| 2006/0277662 | A1 * | 12/2006 | Coccia | 2/300 |
| 2007/0186328 | A1 * | 8/2007 | Bulian | 2/69 |
| 2007/0226869 | A1 * | 10/2007 | Maier | 2/69 |
| 2008/0229486 | A1 * | 9/2008 | Maier | 2/401 |
| 2010/0275351 | A1 * | 11/2010 | Wong | 2/466 |

FOREIGN PATENT DOCUMENTS

| | | |
|---|---|---|
| DE | 202 11311 X | 12/2003 |
| EP | 1 695 637 X | 8/2006 |

* cited by examiner

*Primary Examiner* — Amy Vanatta

(74) *Attorney, Agent, or Firm* — Lucas & Mercanti, LLP

(57) ABSTRACT

Cyclist trousers (12, 112), made from elasticised material and equipped with a least two shaped protection pads (20, 120) for the area for resting on the saddle (14, 114), comprising a substantially unstretchable portion (30, 130), that connects said pads (20, 120) to keep them correctly positioned during use.

10 Claims, 6 Drawing Sheets

CYCLIST TROUSERS WITH PROTECTION PAD

This application claims the priority of EP 07021135 filed Oct. 30, 2007, the priority of which is hereby claimed and incorporated by reference herein.

FIELD OF APPLICATION

The present invention refers, in its most general aspect, to the technical field of cyclist clothing or trousers.

By the term cyclist trousers we mean, in general, any item of clothing suitable for sport cycling, both at amateur and competitive level, like for example shorts or long trousers, with or without braces, tights with or without braces, trousers with short or long-sleeved body suit, etc.

PRIOR ART

It is known to make cyclist trousers equipped with shaped pads to make it more comfortable to sit on the saddle.

In greater detail, a known type of cyclist trousers comprises a padding seat, positioned in the crotch area of the trousers, to protect the perineal and/or ischiatic parts of the sportsman, and reduce the so-called saddle pains.

According to the prior art, such a seat consists of a plurality of layers of "soft" materials, capable of absorbing and damping bumps and fatigue strains, as well as fabric layers intended for contact with the skin. It is also known to associate at least two shaped pads, symmetrical with respect to a middle line of the seat itself, with the rear part of the seat.

The pads are generally shaped with a wider part at the rear area of the seat, which progressively narrows towards the centre of the seat itself, reproducing the shape of the saddle. The pads are made from a soft material of suitable consistency, and are associated with the seat with sewing, heat-sealing, gluing or equivalent techniques.

In the continuous development of cyclist trousers, the technique of shaping the pads very accurately has become common practice, so as to provide support only where strictly necessary, i.e. in the area in contact with the saddle, during pedalling. Indeed, it has been found that pads that are oversized or shaped imprecisely can make the trousers fit badly, i.e. stopping the elasticised fabric from adhering well to the body of the cyclist, and can create uncomfortable creases or wrinkles on the garment itself.

In known trousers there is still the following drawback. The pads, which also move through pedalling, must at all times keep a certain alignment with the saddle, studied for maximum efficiency. Due to the elasticity of the seat and/or of the material constituting the trousers, however, it has been found that the pads (or part of them) can move away from the optimal arrangement, for example "opening" and moving apart, with the result of losing or substantially decreasing their effectiveness.

This phenomenon can mean that the contact area between the cyclist's body and the saddle loses adequate pad support, with a feeling of reduced comfort and/or development of painful symptoms.

SUMMARY OF THE INVENTION

The technical problem forming the basis of the present invention is to devise and provide a seat for cyclist trousers capable of overcoming the aforementioned drawback, and ensuring that the shaped pads are kept in optimal alignment during pedalling.

The problem is solved, according to the invention, by a cyclist trousers made at least partially from elasticised material and equipped with at least two shaped protection pads, positioned in the area of the trousers intended to rest on the saddle, and symmetrically with respect to a median crotch line, characterised in that it comprises a substantially unstretchable portion, placed to mutually connect at least one portion of said shaped pads.

In accordance with possible embodiments of the invention, said substantially unstretchable portion is obtained with an insert or piece with net-type structure, or by spreading with gel, preferably a breathable gel.

According to a first embodiment, the trousers comprise a padding seat, positioned in the crotch area, with which said at least two shaped pads are associated, and that comprises said substantially unstretchable portion.

Said seat comprises an inner face, i.e. facing towards the inside of the trousers, and an opposite outer face; preferably the shaped pads are applied on said outer face of the seat, and the unstretchable portion is represented by an insert of inelastic fabric, also applied on the same outer face of the seat.

It should be noted that the term inelastic fabric is used to mean a fabric not providing elastic behavior, which substantially does not elastically stretch under traction.

More preferably, said unstretchable insert is arranged between the outer face of the seat and the pads themselves, and it is fixed both to the seat and to the pads along the same join lines, for example sewn lines.

According to a further aspect of the invention, the unstretchable seat portion, for example represented by said insert made from inelastic fabric, is provided in the central area of the seat, i.e. the crotch area, so as to substantially connect together the central and front portions of the shaped pads.

Also forming the object of the invention is a seat for cyclist trousers, of the type considered, equipped with a least two shaped protection pads, wherein the pads are positioned symmetrically with respect to a longitudinal middle line of the seat, and said seat comprises at least one substantially unstretchable portion, placed in mutual connection with at least part of said pads.

In accordance with another embodiment, the trousers have no seat, and can be defined substantially as "monocoque". In this other embodiment, the shaped pads are associated with two portions of fabric of said trousers, associated with each other at the crotch line, obtaining a padded area at a part for sitting on the saddle, where the unstretchable portion is also provided.

Advantageously, in said second embodiment, the trousers comprise a plurality of portions of fabric associated with each other perimetrically; two of said portions of fabric, associated with each other at the crotch line, respectively comprise at least one shaped protection pad, obtaining at least two protection pads that are positioned at a part of the trousers for sitting on the saddle, symmetrically with respect to said crotch line.

The portion of unstretchable material is preferably obtained, analogously to what has been stated above, with an insert made from inelastic fabric, sewn or associated with another technique to the respective portions of the trousers, and directly associated, again with sewing or another per se known technique, with the pads or part of them.

In a particularly preferred embodiment, the aforementioned unstretchable portion is provided substantially at the centre of the crotch area of the trousers, by connecting the front-centre part of the pads.

The main advantage of the invention is that the unstretchable portion, by connecting together the pads, keeps them in the optimal design arrangement, studied to absorb the forces from sitting on the saddle. The phenomenon of movement or separation of the pads is eliminated or substantially reduced, especially during intense use, and a greater technical performance and greater comfort for the user compared to known trousers are obtained.

The invention also allows the pads to be shaped and positioned with high precision, so as to provide the padded support only where actually needed, thanks to the face that the pads remain aligned in the optimal alignment even during intense and/or prolonged use.

Further characteristics and advantages of the invention shall become clear from the following description of a preferred embodiment, given for indicating and not limiting purposes with reference to the attached drawings.

DETAILED DESCRIPTION OF A PREFERRED EMBODIMENT

Figure 1:
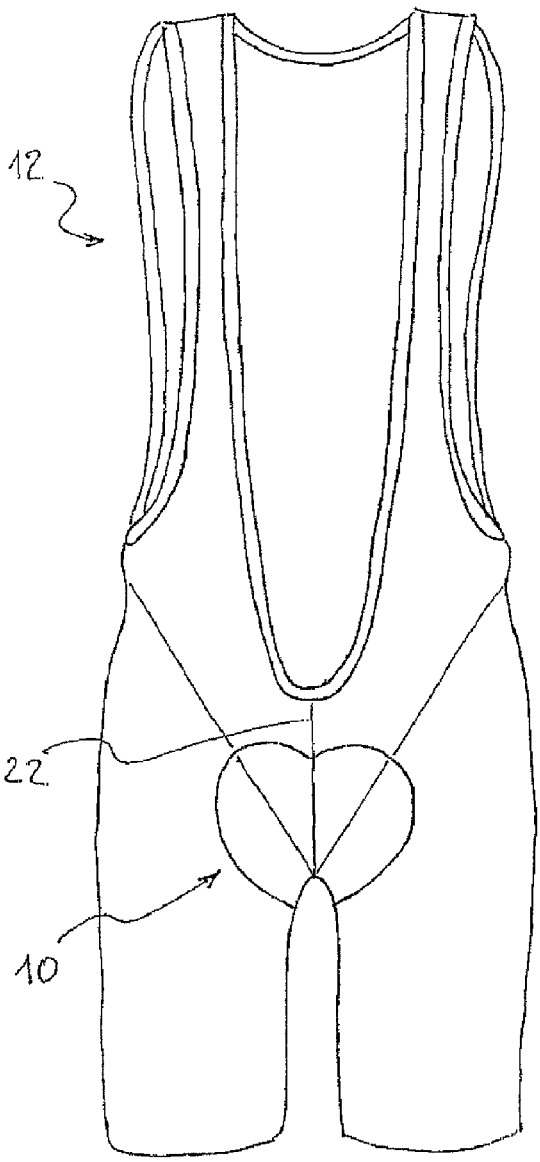
FIG. 1 represents a schematic front view of cyclist trousers according to a first embodiment of the invention.
Figure 2:
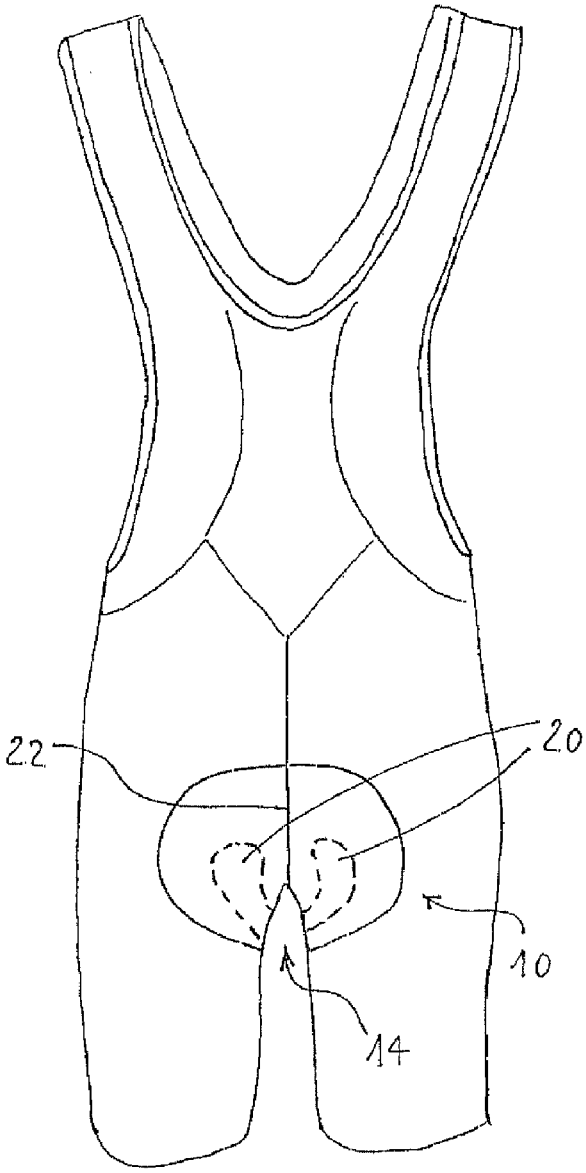
FIG. 2 represents a rear view of the trousers of FIG. 1.

Referring to FIGS. 1 and 2, skin-tight sporting cyclist trousers 12 are shown comprising a padded seat 10 positioned in the crotch area to make it more comfortable to sit on the saddle.

In greater detail, said seat 10 is equipped with two shaped pads 20 (right ad left, respectively), positioned in a crotch area 14 of the trousers 12, intended to rest on the saddle, said pads 20 being symmetrical with respect to a crotch line 22.

Figure 3:
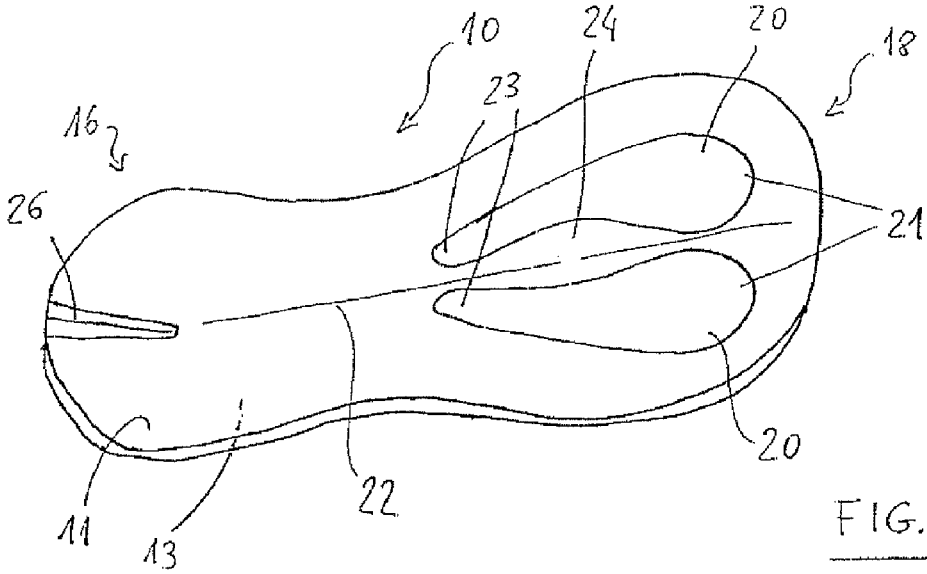
FIG. 3 schematically represents, in a perspective view, a seat for cyclist trousers according to the invention and in particular the seat of the trousers of FIGS. 1 and 2.

The seat 10 (FIGS. 3-4) comprises a surface or inner face 11, facing the inside of the trousers 12 that is towards the cyclist's body, and an opposite outer face 13; it is made, for example, with two layers of elasticised fabric, and an intermediate layer of soft material, like polyester or similar.

The seat 10 substantially comprises a front portion 16 and a rear portion 18, the latter intended to provide a soft support for resting on the saddle. The shaped pads 20 are applied to the outer face 13, at the front part 18, spaced apart and symmetrical with respect to the middle line 22.

Said pads 20 are made from per se known materials, like for example expanded polyurethane, foam rubber, silicon, gel or similar, suitable for absorbing impacts, and are associated with the seat 10 with per se known techniques like sewing, heat sealing or gluing.

The seat 10 also comprises a substantially unstretchable portion 30, preferably made with an insert or piece 31 made from inelastic fabric, not elastically deformable by traction, for example with a net-type structure. Said insert 31 is sewn (or associated with another per se known technique) to the seat 10 and to the pads 20. Said pads 20 are thus connected, at least for part of their extension, by said insert 31.

Figure 4:
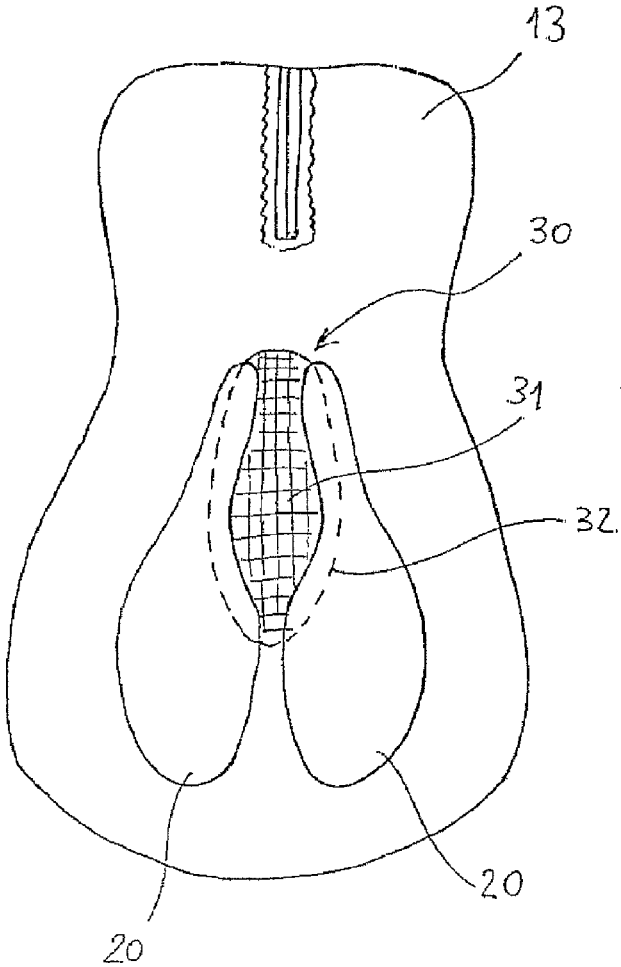
FIG. 4 represents a view from below of the seat of FIG. 3.

In greater detail, the insert 31 is also applied on the outer face 13 of the seat, arranged between the layer of the seat that forms said outer face 13 and the pads 20 themselves, and fixed both to the seat and to the pads along the same sewing lines, indicated as 32 (FIG. 4).

The pads 20 can be variously shaped; preferably, like in the example shown, each pad 20 is anatomically shaped narrowing towards the centre of the seat, with a wider rear portion 21 and a narrower front portion 23; the pads 20, seen in a plan view, substantially converge towards the central area of the seat 10, defining a gap 24 without padding between them. The insert 31 is provided substantially at the centre of the crotch area of the seat 10, by connecting together the central and front portions of the respective pads 20, as exemplified in FIG. 4, with particular reference to the sewing lines 32.

However, it should be noted that the unstretchable portion 30 can be variously sized and positioned with respect to the pads 20. For example, said unstretchable portion 30 can be provided just between the front portions 23 and/or between the rear portions 21, or else it can be made around the pads 20 for their entire size.

According to equivalent embodiments, not shown, the shaped pads can be more than two, for example two or more per side, symmetrical with respect to the crotch line 22. The pads can also be connected by a "bridge" portion of the same soft material, for example connecting the rear portions 21.

The front portion 16 of the seat 10 is preferably convex and shell-shaped, which makes the seat more anatomical and further improves the comfort of use. This shell-shape can be obtained essentially with a V-shaped cut and joining of the respective flaps 26; it is comfortable in particular for male cyclists, because it creates an anatomical area suitable for shielding and supporting the genitals, and it is sized and limited to front areas of the seat 10 that are not subject to the tensions that can derive from the pedalling movement, reducing the compressions in the aforementioned scrotal area of the cyclist.

The seat 10 is associated with the cyclist trousers 12 of FIGS. 1-2, or formed in the trousers themselves. Said seat 10, being arranged at the crotch area 14, protects the perineal and ischiatic areas of the cyclist, which are in contact with the bicycle saddle and subject to rubbing pains during use.

Another embodiment of the invention is shown in FIGS. 5-10. Said figures show a sporting skin-tight garment or cyclist trousers, wholly indicated with 112, made according to the invention and with a structure without a padding seat.

The trousers 112 comprise a plurality of portions of fabric 112*a*-112*e*, preferably made from elasticised fabric, which are associated with each other perimetrically, i.e. that are associated along at least part of their perimeter. For example, elasticised fabrics are used that are associated through stitching, taping, coupling, heat sealing, laser stitching, ultrasound stitching, gluing or similar, which are per se conventional.

Figure 6:
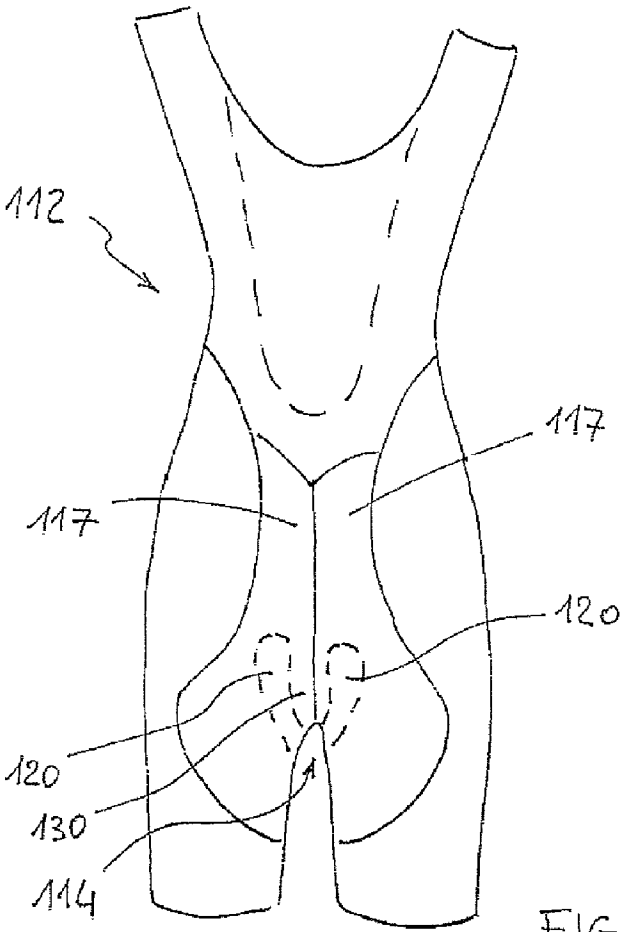
FIG. 6 is a rear view of the trousers of FIG. 5.
Figure 5:
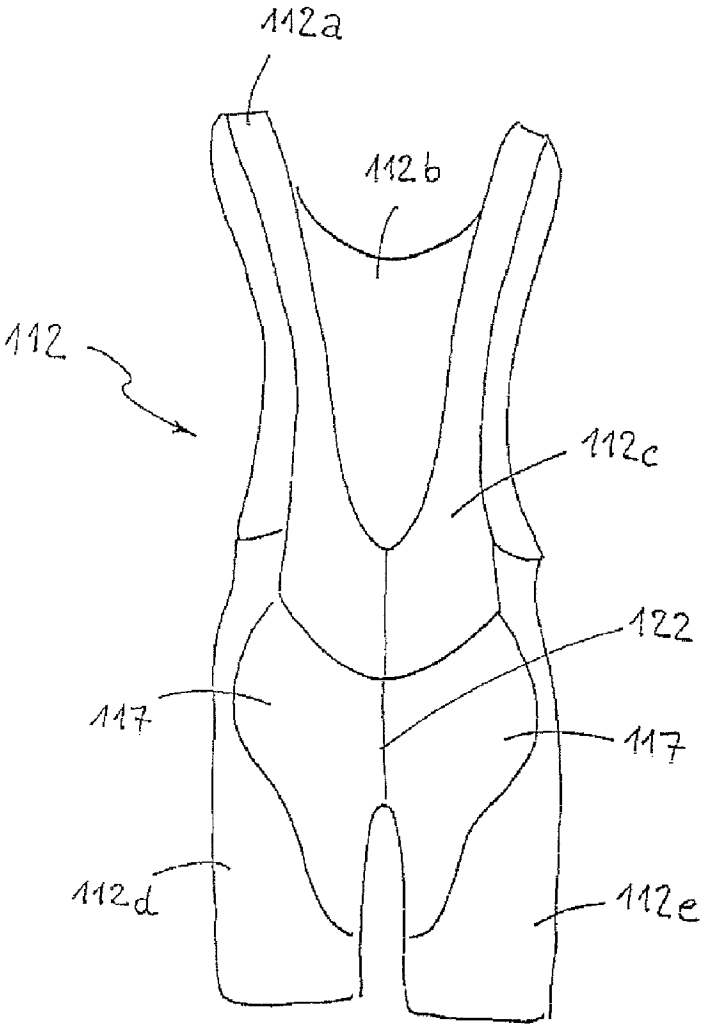
FIG. 5 represents a schematic front view of cyclist trousers according to a further embodiment of the invention.
Figure 7:
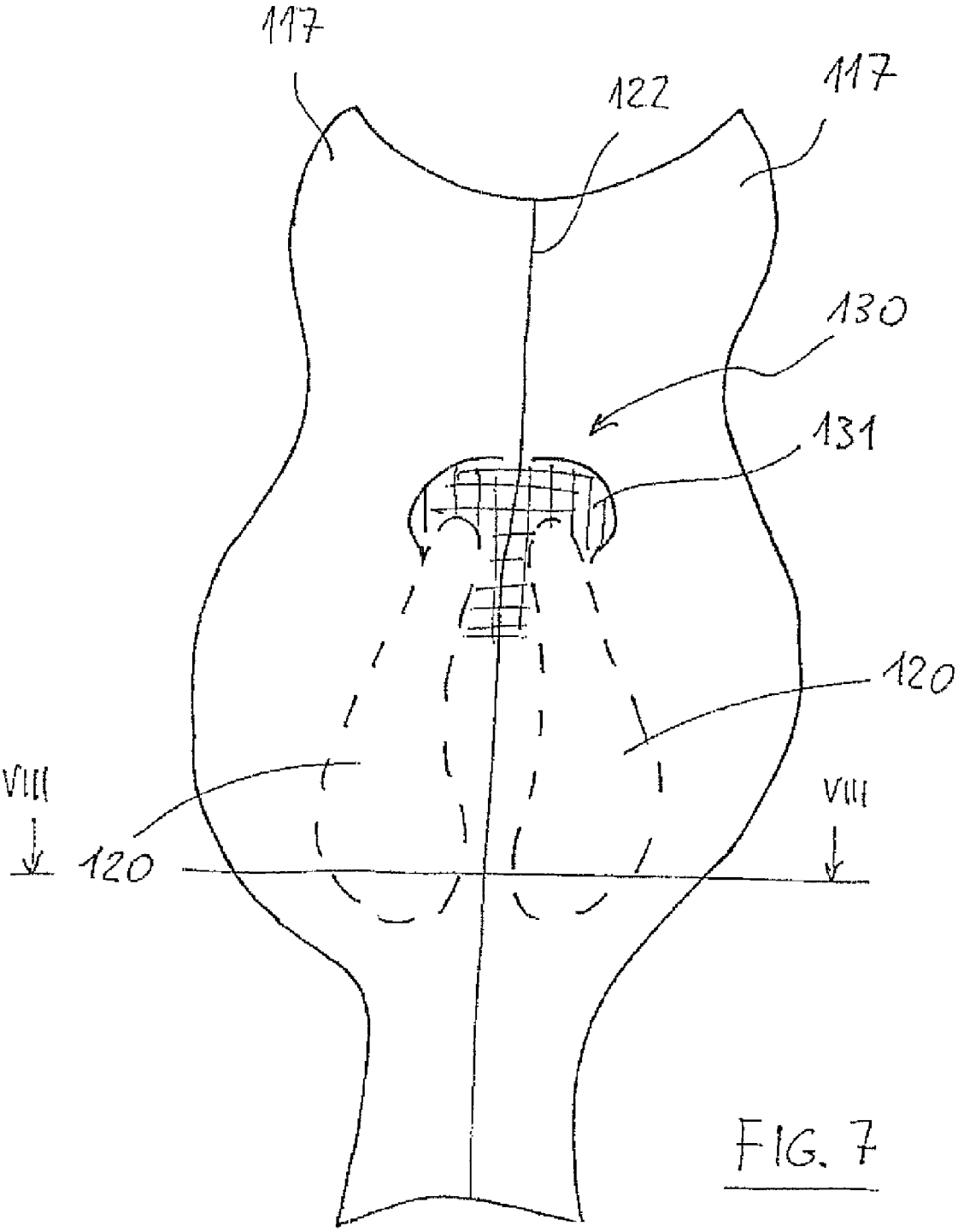
FIG. 7 shows a portion of the trousers of FIGS. 5 and 6.
Figure 8:
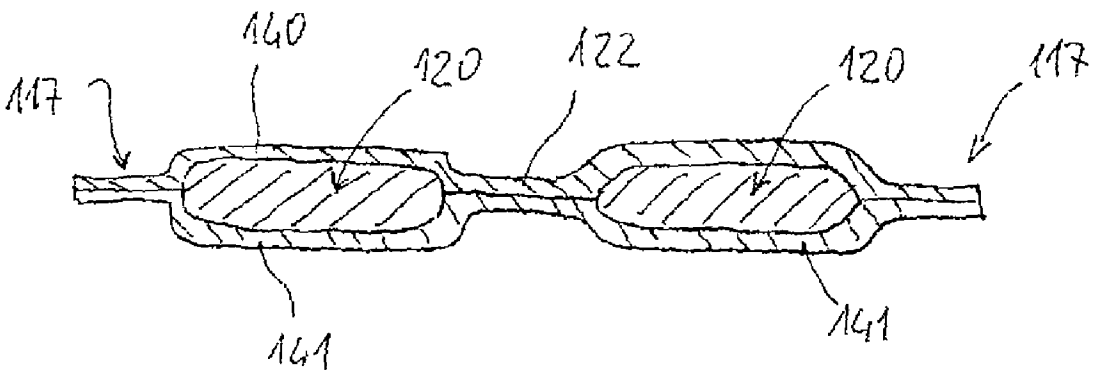
FIG. 8 represents a section according to the line VIII-VIII of FIG. 7.
Figure 9:
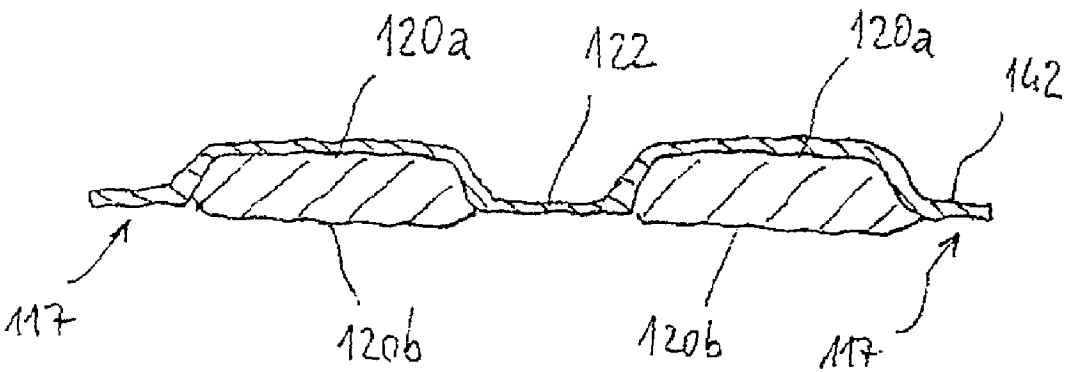
FIG. 9 is analogous to FIG. 8, but represents an alternative embodiment.

The trousers 112 also comprise two distinct portions of fabric, indicated as 117, associated along a crotch line 122. Said portions 117 each comprise at least one shaped protection pad 120 (FIG. 6). Preferably, the fabric of the two portions 117, which carry the pads 120, has greater consistency than the fabric of the remaining portions 112*a*-112*e*.

The pads 120 are positioned at the crotch or saddle part 114 of the trousers 112, suitably spaced apart and arranged symmetrically with respect to the crotch line 122. In a preferred embodiment, the two pads 120 are physically separated from each other, as can be seen in particular from FIG. 7.

The trousers 110 also comprise a substantially unstretchable portion, indicated as 130, placed in connection between the pads 120 or at least part of them. Such a substantially unstretchable portion of fabric can be made with a suitable inelastic insert 131, for example of the net-type, substantially analogously to what has been described in reference to the insert 31 of FIGS. 1-4.

In equivalent embodiments, the unstretchable portion 130 can be made larger or smaller, by connecting the pads just at the front and/or rear portions, or else for their entire size.

Again with reference to FIGS. 5-9, the pads 120, even if of varying shape, are shaped the same and mirror one another. Alternatively, there can be more than two shaped pads, preferably four, two front and two rear, symmetrical with respect to the crotch line.

In accordance with a particularly preferred embodiment (FIG. 8), the two portions of fabric 117 each comprise a first and a second layer of fabric 140, 141, obtaining a substantially pocket-shaped gap, in which said pads 120 are positioned, sewn or associated in another way with the layers of fabric 140, 141.

More precisely, the shaped pads 120 are associated with the layers of fabric 141 and 142 through stitching, taping, coupling, heat sealing, laser stitching, ultrasound stitching, gluing or similar, which are per se conventional.

In a further embodiment (FIG. 9), the portions 117 each comprise a single layer of fabric 142, the shaped pads 120 being associated with said layer of fabric 142, through sewing or the other aforementioned techniques.

An inner face 120*a* of the pads 120 is arranged opposite/in contact with the layer 122, whereas the opposite face 120*b* constitutes an outer surface of the portions 117. Once the trousers are being worn, the opposite face can face towards the bicycle saddle or else towards the cyclist's skin.

The unstretchable insert is substantially at the middle area 122.

Advantageously, the portions of fabric 117 are made from a fabric identical to that of the other portions 112 but subjected to different treatment. In particular, at least the side that goes into contact with the cyclist's skin is subjected to a treatment selected from the group comprising scraping, raising or fluffing. Preferably, fluffing treatment is used, lifting up part of the outside that makes such a side soft and comfortable with an effect typical of pile fabric.

Figure 10:
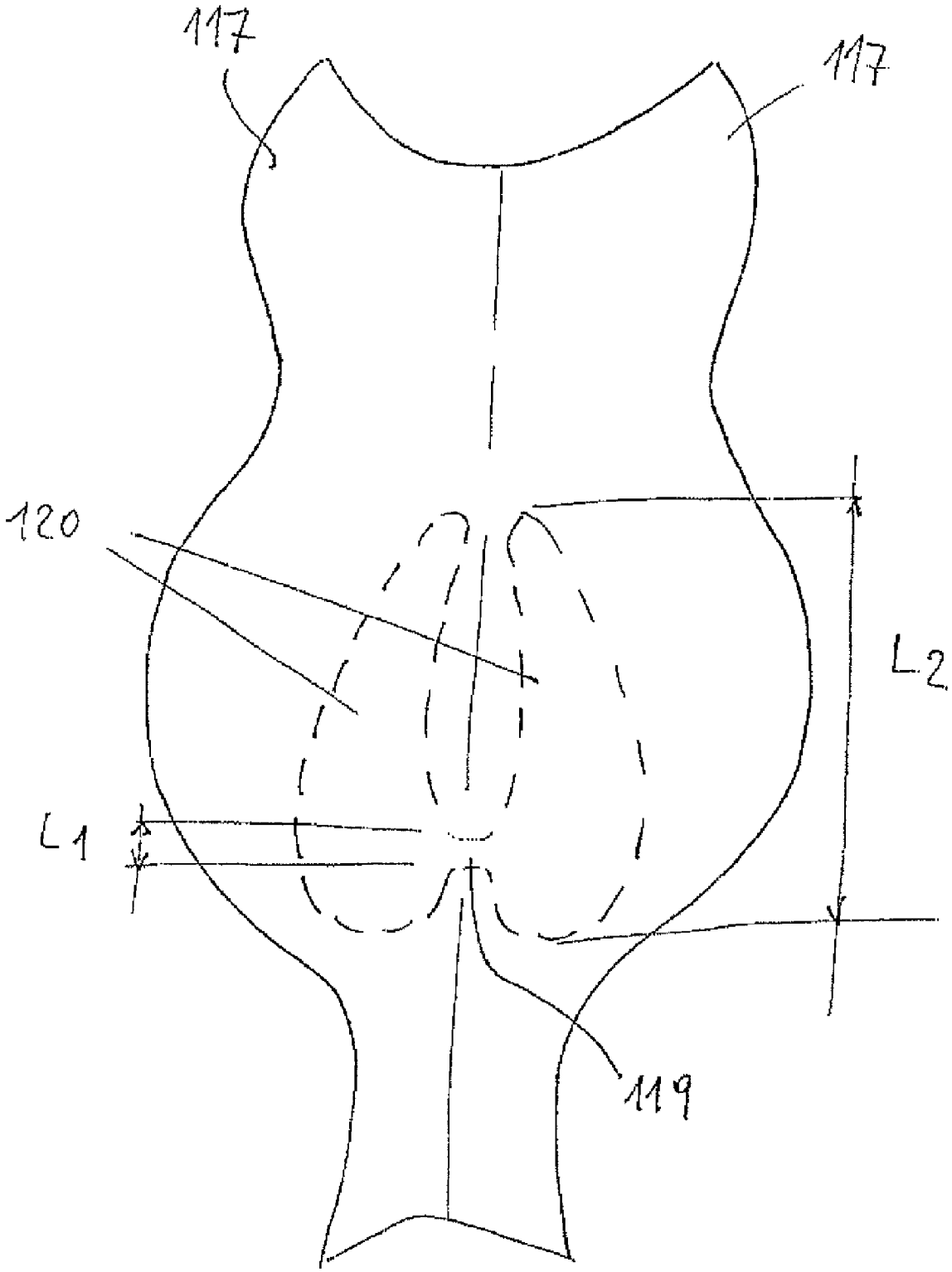
FIG. 10 represents, in an analogous way to FIG. 7, an alternative embodiment of the same portion of the trousers of FIG. 5-6.

According to a further embodiment of FIG. 10, the protection shaped pads 120 are connected together through at least one "bridge" portion 119.

Preferably, the bridge portion 119 extends transversally, for example perpendicularly, with respect to the crotch line 122 of the trousers, it is substantially rectangular and has a width L1 substantially smaller than the axial extension L2 of the pads 120: advantageously, the width L1 is less than 15% of the axial extension L2.

The bridge portion 119 is preferably positioned so as to remain substantially still with respect to the bicycle saddle, during the cyclist's normal pedalling. In this way, the bridge portion 119 does not hinder the natural movement of the two pads 120 during the cyclist's pedalling: in practice, the two pads 120 connected by such a bridge portion 119 move in substantially the same way as the two pads 18 and 20 of FIG. 3.

The bridge portion 119 also has the advantage of simplifying the centring and the positioning of the pads 120 during the manufacturing process of the trousers 112.

The main advantage of the invention consists of keeping the pads aligned. For example, with reference to FIGS. 3-4, it can be understood that the unstretchable insert 31 has the effect of preventing the pad portions 23 from separating and moving apart, keeping them aligned and along the same axis as the saddle. Analogously, and with reference to the embodiment of FIG. 5 and thereafter, the portion 130 has the effect of keeping the pads 120 aligned, preventing them from "opening" following the deformation of the elasticised fabric.

Further advantages that can be accomplished with the embodiment of FIGS. 5-10 are the following: improved freedom in the movement of the cyclist's legs; the saddle area has characteristics of better breathability and sweat removal, especially in the embodiment with a single layer of fabric in the saddle part; the crotch line of the trousers has no sewing, heat sealing, gluing or similar for the padding. This makes the trousers particularly comfortable, thanks to the elasticity of its crotch area, which allows the cyclist to have a natural freedom of movement, practically without any constriction and hindrance, minimising the possibilities of irritation. Moreover, the risk of the padding becoming unstitched or unglued from the crotch line of the trousers is eliminated.

The invention claimed is:

1. Cyclist trousers, made at least partially from elasticized material, comprising:

at least two shaped protection pads, said shaped protection pads being positioned in a region of the trousers intended to rest on a saddle of a bicycle and said shaped protection pads being symmetrical with respect to a median crotch line of said trousers; and only one substantially unstretchable fabric portion, which is applied to a crotch area of said trousers with the only one substantially unstretchable fabric portion directly connecting at least part of each of said shaped pads together.

2. The cyclist trousers according to claim 1, further comprising a seat positioned in the crotch area of the trousers with said shaped pads and the unstretchable fabric portion being arranged on the seat.

3. The cyclist trousers according to claim 2, wherein said seat has an inner face facing towards an inside of the trousers and an opposite outer face, the shaped pads , and said unstretchable fabric portion, which is an insert of inelastic fabric, are applied on said outer face of the seat.

4. The cyclist trousers according to claim 3, wherein said insert is arranged between said outer face of the seat and the protection pads, and said insert is fixed both to the seat and to the shaped pads along same joining lines.

5. The cyclist trousers according to claim 2, wherein said unstretchable portion is arranged substantially in a central part of a crotch area of said seat so that a central portion of said shaped protection pads and a front portion of the shaped pads are connected together by said unstretchable fabric portion.

6. The cyclist trousers according to claim 2, wherein the seat has a substantially convex and shell-shaped front portion, obtaining an anatomical area suitable for shielding and supporting male genitals.

7. The cyclist trousers according to claim 1, further comprising a seat with the at least two shaped pads positioned symmetrically with respect to a longitudinal middle line of the seat, and the substantially unstretchable fabric portion arranged to mutually connect at least part of said shaped pads.

8. The cyclist trousers according to claim 1, wherein said shaped pads are associated with two portions of fabric of said trousers, associated with each other at the crotch line, obtaining a padded area at a saddle part, and said trousers also comprise said unstretchable portion.

9. The cyclist trousers according to claim 8, wherein said unstretchable portion is obtained with an insert made from inelastic fabric, associated with said portions of trousers that carry the pads, and directly associated with said pads or part of them.

10. The cyclist trousers according to claim 8, wherein said unstretchable portion is provided substantially in the central part of the crotch area, so as to connect together the respective central and front portions of the shaped pads.

* * * * *